United States Patent [19]

Narisoko et al.

[11] Patent Number: 4,702,177

[45] Date of Patent: Oct. 27, 1987

[54] WASTE PRODUCT FEEDER

[75] Inventors: Minoru Narisoko; Mikio Kiyotomo, both of Matsudo, Japan

[73] Assignee: Ishikawajima-Harima Jukogyo Kabushiki Kaisha, Tokyo, Japan

[21] Appl. No.: 858,653

[22] Filed: May 2, 1986

[30] Foreign Application Priority Data

May 14, 1985 [JP] Japan ..... 60-102418

[51] Int. Cl.[4] ..... F23K 3/14

[52] U.S. Cl. ..... 110/110; 110/222; 110/223; 110/327; 241/280; 241/600; 414/190; 414/197

[58] Field of Search ..... 110/101 R, 102, 108, 110/110, 218–220, 222–223, 235, 245, 255, 267, 283, 286, 293, 327; 414/160, 172, 187, 190, 197; 241/600, 280, 186 A

[56] References Cited

U.S. PATENT DOCUMENTS

| | | | |
|---|---|---|---|
| 1,506,924 | 9/1924 | Gairing | 414/197 |
| 1,922,960 | 8/1933 | Klein | 110/110 |
| 2,285,236 | 6/1942 | Van Etten | 110/108 |
| 3,472,185 | 10/1969 | Burden, Jr. | 110/110 |
| 3,776,150 | 12/1973 | Evans et al. | 110/245 |
| 3,804,343 | 4/1974 | Moffitt | 241/280 X |
| 3,841,465 | 10/1974 | Miller, Jr. et al. | 241/280 X |
| 4,274,786 | 6/1981 | Svensson et al. | 241/280 X |

OTHER PUBLICATIONS

Hagihara, "450 Tld Fluidized-Bed Type Municipal Incinerator Plant," IHI Engineering Review, vol. 16, No. 2, pp. 1–6, 04–1983.

*Primary Examiner*—Albert J. Makay
*Assistant Examiner*—Steven E. Warner

[57] ABSTRACT

A waste product feeder in which when waste products are charged through a hopper into a trough are transported by a screw and then discharged, they are successively scraped by a scraper in a predetermined quantity or volume.

21 Claims, 21 Drawing Figures

WASTE PRODUCT FEEDER

BACKGROUND OF THE INVENTION

The present invention relates to a waste product feeder for use in an incinerator plant.

FIG. 21 shows a waste product feeder used in an incinerator plant in which the lower end of a hopper 1 is connected to a trough 3 provided with a screw 2. Waste products are charged through the hopper 1 into the trough 3, are forced to move in the lateral direction by rotation of the screw 2 and are discharged from a discharge port 5. The discharged waste products 4 are charged through a chute 6 into an incinerator 7 and burned.

Various kinds of waste products 4 are charged into the waste product feeder so that control in quantity of the waste products discharged therefrom is difficult to carry out. More specifically, when the waste products 4 which are large in size or viscous are forced by the screw 2 to the discharge port 5, the products 4 at the lower half portion of the leading end of the screw 2 are relatively smoothly cut off while those at the upper half portion are hardly cut off. As the waste products 4 are successively forced toward the discharge port 5, the waste products 4 which have not been cut off are forced to be compressed and accumulated in the trough 3 above the leading end of the screw 2. As a result, a large body 4' of waste products is formed and then drops into the incinerator 7 to be burned. This causes a temporary lack of oxygen in the incinerator 7, resulting in the incomplete combustion, causing smoke pollution. This applies especially in the case of a fluidized-bed type incinerator since the burning speed therein is extremely high and the quantity of the air cannot be instantenously controlled.

In view of the above, one of the objects of the present invention is to provide a waste product feeder which can brake or a squeeze the waste products to be discharged in a suitable manner so that a predetermined quantity of waste products is cut off.

The above and other objects, effects, features and advantages of the present invention will become more apparent from the following description of some preferred embodiments thereof taken in conjunction with the accompanying drawings.

DETAILED DESCRIPTION OF THE PREFERRED EMBODIMENTS

Figure 1:
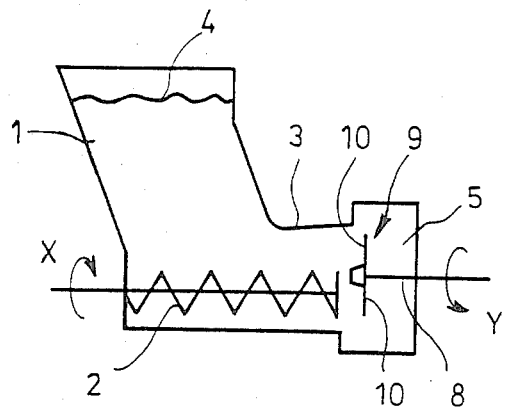
FIG. 1 is a schematic side view of a first embodiment of the present invention.
Figure 21:
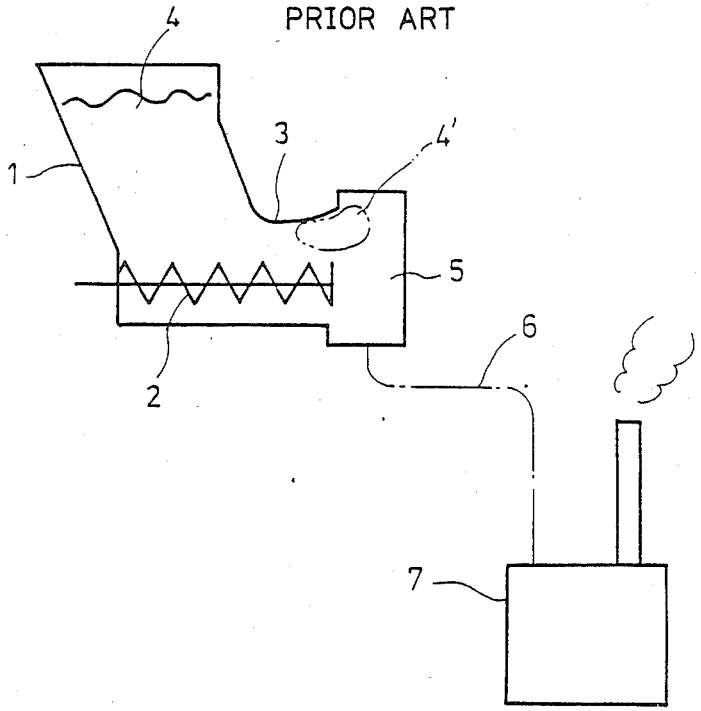
Fig.21 PRIOR ART
FIG. 21 is a view used to explain a conventional waste product feeder.

FIG. 1 shows a waste product feeder in accordance with the present invention and same reference numerals in FIG. 1 are used to designate similar parts in FIG. 21. A rotating shaft 8 extends through the trough 3 slightly above the axis of the screw 2 and outwardly beyond the trough 3. A scraper 9 for scraping the waste products 4 transported toward the leading end of the screw is attached to a leading end of the rotating shaft 8.

Figure 2:
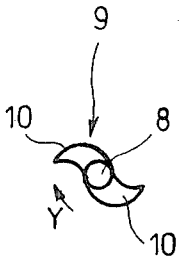
FIG. 2 is a front view of a scraper thereof.

The screw 2 is rotated in the direction X while the scraper 9 is rotated in the direction Y opposite to the direction X. As best shown in FIG. 2, the scraper 9 comprises a pair of blades 10 each like a bird's beak and which are curved opposite to the direction Y and are symmetrical about the axis of the rotating shaft 8. That is, the pair of scraper blades 1 are angularly spaced apart from each other by 180°.

Therefore, the waste products 4 which are successively transported by the screw 2 are continuously cut off in a predetermined quantity by the rotation of the scraper 9. The scraper 9 is spaced apart from the leading or discharge end of the screw 2 by a suitable distance depending upon the kinds of waste products 4 so that the braking action (squeezing action) is applied to the waste products 4 to be discharged. As a result, the quantity of waste products 4 cut off at the leading or discharge end of the screw 2 can be suitably controlled. As a result, the formation and growth of the body 4' of waste products (See FIG. 21) can be prevented so that the incomplete combustion in the incinerator can be avoided.

When the screw 2 and the scraper 9 are rotated in the same direction, it is preferable that the rotational speed of the scraper 9 is determined faster than that of the screw so that shearing forces can be readily produced between the waste products 4 and the scraper 9. In this case, the front view of the scraper 9 becomes a rear view of FIG. 2.

In the first embodiment, the rotating shaft 8 extends above the screw shaft. The reason is that the blades 10 of the scraper 9 pass the upper half portion of the leading or discharge end of the screw 2 where the body 4' of waste products tends to be formed and grown, so that the waste product body 4' can be efficiently cut off or scraped. Therefore, if the blades 10 are sufficiently large in size, the rotating shaft 8 may extend in line with the axis of the screw 2.

Figure 3:
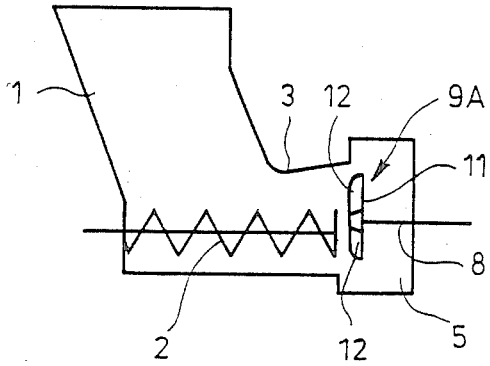
FIG. 3 is a schematic side view of a second embodiment of the present invention.
Figure 4:
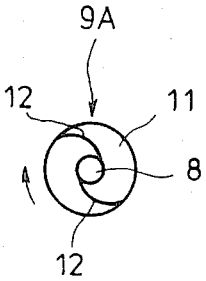
FIG. 4 is a front view of a scraper thereof.

Next referring to FIGS. 3 and 4, the second embodiment of the present invention will be described. In the second embodiment, a disk-shaped supporting plate 11 is attached to the leading or inner end of the rotating shaft 8 at right angles thereto and is provided with a pair of blades 12 which are curved so as to be concave in the opposite direction to rotation of the supporting plate 11. Thus a scraper 9A is constructed. The second embodiment with the construction described above has an advantage over the first embodiment in that the area of the waste products 4 to be scraped is increased.

Figure 5:
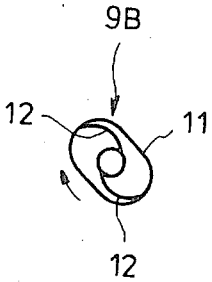
FIGS. 5 and 6 are front views of scrapers, respectively, of a third and a fourth embodiment of the present invention.
Figure 6:
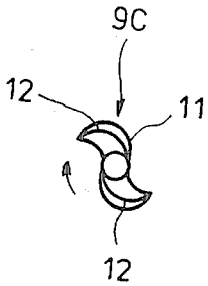

FIGS. 5 and 6 show the third and fourth embodiments, respectively, of the present invention. In the third embodiment as shown in FIG. 5, a scraper 9B has an elliptical supporting plate 11 (which corresponds to the supporting plate 11 as shown in FIG. 4). In the fourth embodiment as shown in FIG. 6, a scraper 9C has a supporting plate 11 which is substantially similar in shape to the pair of blades 10 as shown in FIG. 2. Therefore, the waste products 4 can be scraped both by the supporting plate 11 and a pair of blades 12.

Figure 7:
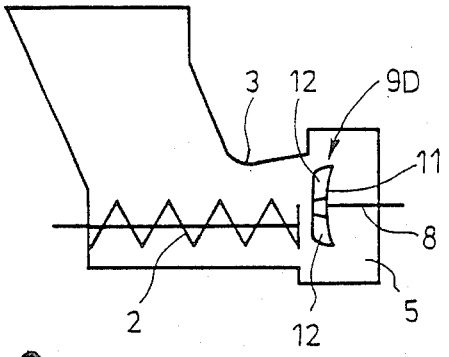
FIG. 7 is a schematic side view of a fifth embodiment of the present invention.

FIG. 7 shows the fifth embodiment of the present invention. A scraper 9D has a supporting plate 11 which is similar in construction to any of those as shown in FIGS. 4, 5 and 6, but the surface of the supporting plate 11 of the fifth embodiment is somewhat curved. As a result, as compared with the second, third and fourth embodiments, the blades 12 of the fifth embodiment can scrape a larger area.

Figure 8:
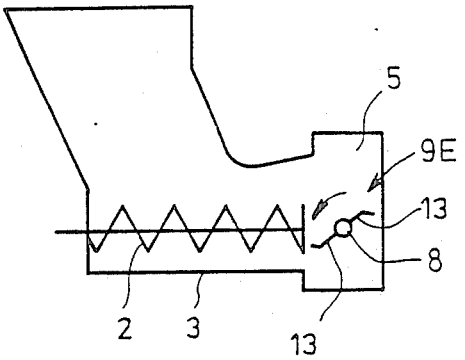
FIG. 8 is a schematic side view of a sixth embodiment of the present invention.
Figure 9:
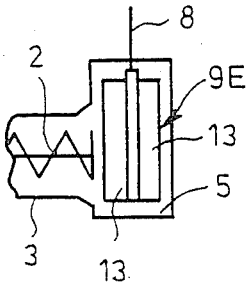
FIG. 9 is a fragmentary plan view thereof.

FIGS. 8 and 9 show the sixth embodiment of the present invention. A rotating shaft 8 extends in the horizontal direction and is perpendicular to the axis of a screw 2 and a pair of rectangular flat blades 13 are carried by the rotating shaft 8, whereby a scraper 9E is provided.

Figure 10:
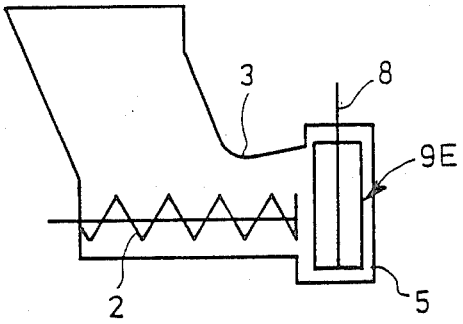
FIG. 10, is a schematic side view of a seventh embodiment of the present invention.
Figure 11:
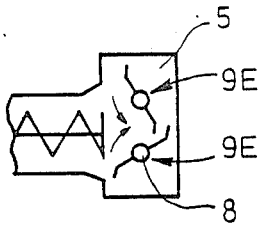
FIG. 11 is a fragmentary plan view thereof.

FIGS. 10 and 11 show the seventh embodiment of the present invention in which a pair of scrapers 9E are disposed in the vertical direction so as to scrape the waste products 4 independently of each other.

Figure 12:
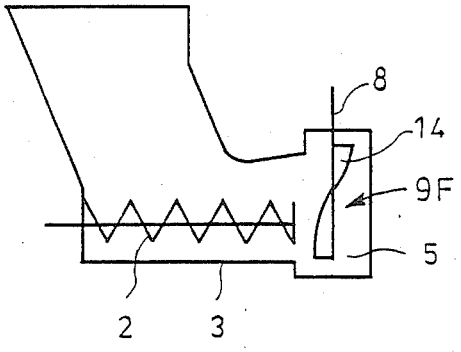
FIG. 12 is a schematic side view of an eigth embodiment of the present invention.
Figure 13:
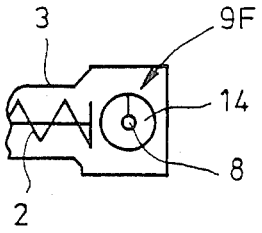
FIG. 13 is a fragmentary plan view thereof.

FIGS. 12 and 13 show the eigth embodiment of the present invention. A scraper 9F comprises a twisted blade 14 carried by a rotating shaft 8 disposed vertically.

Figure 14:
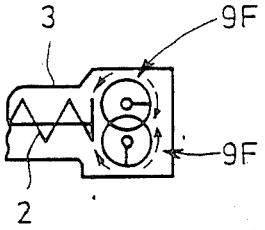
FIG. 14 is a fragmentary plan view of a ninth embodiment of the present invention.

FIG. 14 shows the ninth embodiment of the present invention in which a pair of scrapers 9F are disposed in the horizontal direction and are perpendicular to the axis of the screw 2.

According to the eighth or ninth embodiment, the blade 14 rotated in a predetermined direction serves to not only scrape the waste products 4 but also force the same downwardly.

Figure 15:
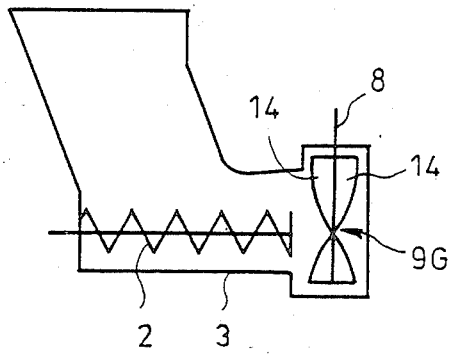
FIG. 15 is a schematic side view of a tenth embodiment of the present invention.
Figure 16:
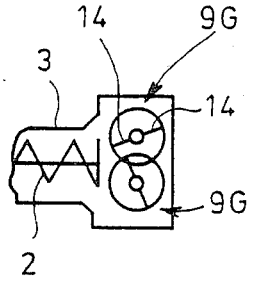
FIG. 16 is a fragmentary plan view thereof.

FIGS. 15 and 16 show the tenth embodiment of the present invention in which each of scrapers 9G comprises a pair of blades 14 which are similar in construction to that of the ninth embodiment and which are attached to a rotating shaft 8. As a result, as compared with the ninth embodiment, the effects for scraping the waste products 4 and forcing them downwardly is much enhanced.

Figure 17:
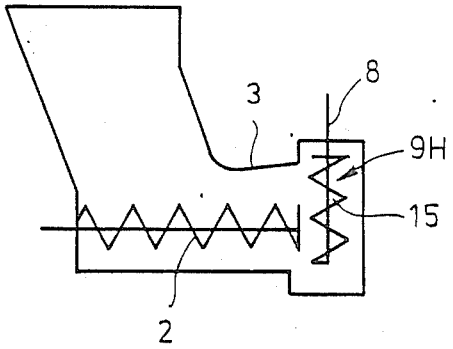
FIG. 17 is a schematic side view of an eleventh embodiment of the present invention.

FIG. 17 shows the eleventh embodiment of the present invention in which a screw-like scraper 9H comprises a helical blade 15 carried by a rotating shaft 8 which is disposed vertically. Therefore, the eleventh embodiment can also ensure the positive scraping of the waste products 4 and forcing the scraped waste products downwardly.

Figure 18:
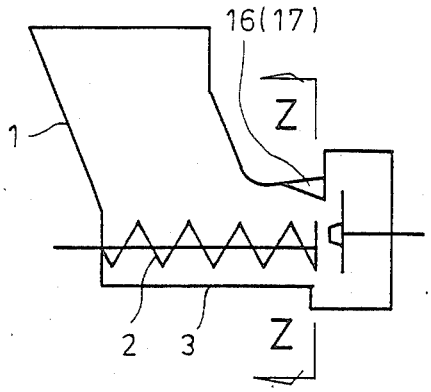
FIG. 18 is a schematic side view of a twelfth embodiment of the present invention.
Figure 19:
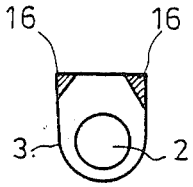
FIGS. 19 and 20 are sectional views taken along the line Z—Z of FIG. 18.
Figure 20:
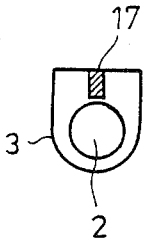

In the embodiments described above, various scrapers are disposed at the discharge ports 5 of the troughs 3; but the construction as shown in FIGS. 18–20 when used with various scrapers discussed above can further enhance the scraping effect of waste products. That is, as shown in FIG. 18, guide members 16 (See FIG. 19) which cover the corners of the trough 3 or a guide member 17 (See FIG. 20) which extends along the center line of the upper wall of the trough 3 is attached to the trough 3 so that the guide member guides the waste products 4, which are transported by the screw 2, toward the scraper.

As described above, according to the present invention, the waste products which are transported by the screw can be continuously scraped in a predetermined quantity by the rotation of the scraper so that the formation and growth of waste products in the conventional waste product feeder can be prevented and consequently the incomplete combustion in the incinerator can be eliminated.

What is claimed is:

1. A waste product feeder for waste products comprising a hopper into which waste products are charged, a horizontal trough connected to a lower end of said hopper into which the waste products are moved, a screw operable in said trough for transporting the waste products in a horizontal direction, said trough having a discharge port through which said waste products are discharged, the waste products being compressed and accumulated in the trough and discharge port above a discharge end of the screw as they are successively forced by the screw toward the discharge port, and a scraper rotatably disposed in the discharge port and located to pass above the upper half portion of the discharge end of the screw for cutting off a predetermined quantity of the waste products transported to the discharge end of the screw.

2. A feeder according to claim 1 wherein a rotating shaft of at least one said scraper is disposed horizontally and is perpendicular to an axis of the screw.

3. A feeder according to claim 2 wherein said scraper comprises rectangular flat plates.

4. A feeder according to claim 1 wherein a rotating shaft of said scraper extends parallel to an axis of said screw.

5. A feeder according to claim 4 wherein said scraper comprises blades each in the form of a bird's beak.

6. A feeder according to claim 4 wherein said scraper comprises a supporting plate and curved blades.

7. A feeder according to claim 4, wherein the rotating shaft of said scraper extends above the axis of said screw.

8. A feeder according to claim 1 wherein a rotating shaft of said scraper is disposed vertically and is perpendicular to an axis of said screw.

9. A feeder according to claim 8 wherein said scraper comprises rectangular flat plates.

10. A feeder according to claim 8 wherein said scraper comprises a twisted plate.

11. A feeder according to claim 8 wherein said scraper comprises a helical plate.

12. A feeder according to claim 1 further comprising guide means in the trough above the discharge end of the screw for guiding the waste products transported by the screw toward said scraper.

13. A feeder according to claim 12 wherein a rotating shaft of at least one said scraper is disposed horizontally and is perpendicular to an axis of the screw.

14. A feeder according to claim 13 wherein said scraper comprises rectangular flat plates.

15. A feeder according to claim 12 wherein a rotating shaft of said scraper extends parallel to an axis of said screw.

16. A feeder according to claim 15 wherein said scraper comprises blades each in the form of a bird's beak.

17. A feeder according to claim 15 wherein said scraper comprises a supporting plate and curved blades.

18. A feeder according to claim 12 wherein a rotating shaft of said scraper is disposed vertically and is perpendicular to an axis of said screw.

19. A feeder according to claim 18 wherein said scraper comprises rectangular flat plates.

20. A feeder according to claim 18 wherein said scraper comprises a twisted plate.

21. A feeder according to claim 18 wherein said scraper comprises a helical plate.

* * * * *